US012345037B1

(12) United States Patent
Boor

(10) Patent No.: US 12,345,037 B1
(45) Date of Patent: Jul. 1, 2025

(54) BOLTED TRUSS SPLICE

(71) Applicant: Lester Building Systems, LLC., Lester Prairie, MN (US)

(72) Inventor: Paul A. Boor, Hutchinson, MN (US)

(73) Assignee: Lester Building Systems, LLC., Hutchinson, MN (US)

( * ) Notice: Subject to any disclaimer, the term of this patent is extended or adjusted under 35 U.S.C. 154(b) by 349 days.

(21) Appl. No.: 18/131,197

(22) Filed: Apr. 5, 2023

Related U.S. Application Data

(60) Provisional application No. 63/327,527, filed on Apr. 5, 2022.

(51) Int. Cl.
*E04B 1/26* (2006.01)
*E04B 1/38* (2006.01)

(52) U.S. Cl.
CPC ..... *E04B 1/2608* (2013.01); *E04B 1/388* (2023.08); *E04B 2001/2644* (2013.01); (Continued)

(58) Field of Classification Search
CPC ..... E04B 1/2608; E04B 1/388; E04B 2001/2644; E04B 2001/2652; E04B 2001/266; E04B 2001/2692
See application file for complete search history.

(56) References Cited

U.S. PATENT DOCUMENTS 4,275,537 A * 6/1981 Pinson ..... E04C 3/292 52/642
5,622,022 A * 4/1997 Haisch ..... E04C 3/17 52/696

(Continued)

*Primary Examiner* — Rodney Mintz
(74) *Attorney, Agent, or Firm* — Glen E. Schuman; Moss & Barnett

(57) ABSTRACT

A bolted truss splice that includes a first force distribution bar, a first collection plate, a second force distribution bar, a second collection plate, a tension plate, a truss member and a fastening mechanism. The first force distribution bar has a first side surface, a second side surface and an end surface. The first collection plate extends over at least part of the first side surface of the first force distribution bar, the second side surface of the first force distribution bar and the end surface of the first force distribution bar. The second force distribution bar has a first side surface, a second side surface and an end surface. The second collection plate extends over at least part of the first side surface of the second force distribution bar, the second side surface of the second force distribution bar and the end surface of the second force distribution bar. The truss member has an end, a first side surface and a second side surface that is opposite the first side surface. The first collection plate is attached to first side surface of the truss member so that the first force distribution bar is proximate the end of the truss member. The second collection plate is attached to the second side surface of the truss member so that the second force distribution plate is proximate the end of the truss member. The fastening mechanism is capable of extending through the first collection plate, the first force distribution bar, the second collection plate, the second force distribution bar and the tension plate to retain the tension plate in engagement with the truss member.

20 Claims, 4 Drawing Sheets

(52) U.S. Cl.
CPC ..... *E04B 2001/2652* (2013.01); *E04B 2001/266* (2013.01); *E04B 2001/2692* (2013.01)

(56) References Cited

U.S. PATENT DOCUMENTS

| | | | | | |
|---|---|---|---|---|---|
| 5,819,494 | A * | 10/1998 | Haisch | E04C 3/11 | 52/696 |
| 5,966,892 | A * | 10/1999 | Platt | E04B 1/26 | 52/715 |
| 10,870,991 | B2 * | 12/2020 | Brakeman | E04C 3/17 | |
| 11,326,346 | B2 * | 5/2022 | Brakeman | E04C 3/17 | |
| 2011/0252732 | A1 * | 10/2011 | Morrett | E04C 3/17 | 52/309.1 |
| 2019/0093361 | A1 * | 3/2019 | Brakeman | E04B 7/022 | |
| 2021/0079652 | A1 * | 3/2021 | Brakeman | E04B 1/2608 | |

* cited by examiner

BOLTED TRUSS SPLICE

REFERENCE TO RELATED APPLICATION

This application claims priority to Provisional Applic. No. 63/327,527, filed on Apr. 5, 2022, the contents of which are incorporated herein by reference.

FIELD OF THE INVENTION

The invention relates generally to trusses. More particularly, the invention relates to a bolted truss splice.

BACKGROUND OF THE INVENTION

Trusses are the most efficient means of spanning large distances in building roofs. The trusses fabricated from dimensional lumber and light gauge metal plates that have been stamped to produce a multitude of integral teeth (truss plates) are very common in residential, agricultural, and light commercial/industrial applications.

Lumber trusses assembled with truss plates provide extreme design flexibility, very short lead times, and often the lowest material cost for spans up to about 160 feet. Designs for lumber trusses of this size can be readily produced with current software.

Unfortunately, trusses at the upper end of this range cannot be manufactured or delivered as a single assembly. Super wide trusses can, however, be manufactured and delivered in two halves. The two halves must be connected at the construction site to form the complete truss.

The obvious and lowest material cost to make this connection would be to install the truss plates that would have been used if manufacturing and transportation issues did not preclude shipping the assembly as a single unit.

However, it is not practical to install large truss plates in the field because of the large force required to embed the large plates required. Further, trusses of this size are nearly always multiple plies that are nail laminated at the factory. All of that work would need to occur in the field to allow access to both sides of each laminate as required for proper plating.

A means of efficiently field connecting factory built, large truss plate connected wood sub-assemblies is needed to take advantage of the potential cost savings provided by utilizing lumber trusses in the construction of large buildings Current methods of connecting plated wood assemblies include steel or wood gussets with field drilled holes and bolts or large numbers of screws or nails. Occasionally, the entire center section of the truss is produced and fastened over the splice region. These methods have both high labor and material costs.

What is needed is a system that combines the simplicity and speed of field assembled bolted steel connections found in rigid steel frames with the ease of manufacture and efficient force transfer associated with truss plates.

SUMMARY OF THE INVENTION

An embodiment of the invention is directed to a bolted truss splice that includes a first force distribution bar, a first collection plate, a second force distribution bar, a second collection plate, a tension plate, a truss member and a fastening mechanism. The first force distribution bar has a first side surface, a second side surface and an end surface. The first collection plate extends over at least part of the first side surface of the first force distribution bar, the second side surface of the first force distribution bar and the end surface of the first force distribution bar. The second force distribution bar has a first side surface, a second side surface and an end surface. The second collection plate extends over at least part of the first side surface of the second force distribution bar, the second side surface of the second force distribution bar and the end surface of the second force distribution bar. The truss member has an end, a first side surface and a second side surface that is opposite the first side surface. The first collection plate is attached to first side surface of the truss member so that the first force distribution bar is proximate the end of the truss member. The second collection plate is attached to the second side surface of the truss member so that the second force distribution plate is proximate the end of the truss member. The fastening mechanism is capable of extending through the first collection plate, the first force distribution bar, the second collection plate, the second force distribution bar and the tension plate to retain the tension plate in engagement with the truss member.

Another embodiment of the invention is directed to a bolted truss splice that includes a first truss, a second truss, a tension plate, a first fastening mechanism and a second fastening mechanism. The first truss includes a first force distribution bar, a first collection plate and a first truss member. The first force distribution bar has a first side surface, a second side surface and an end surface. The first collection plate extends over at least part of the first side surface of the first force distribution bar, the second side surface of the first force distribution bar and the end surface of the first force distribution bar. The first truss member has an end, a first side surface and a second side surface that is opposite the first side surface. The first collection plate is attached to first side surface of the first truss member so that the first force distribution bar is proximate the end of the first truss member. The second truss includes a second force distribution bar, a second collection plate and a second truss member. The second force distribution bar has a first side surface, a second side surface and an end surface. The second collection plate extends over at least part of the first side surface of the second force distribution bar, the second side surface of the second force distribution bar and the end surface of the second force distribution bar. The second truss member has an end, a first side surface and a second side surface that is opposite the first side surface. The second collection plate is attached to the first side surface of the second truss member so that the second force distribution plate is proximate the end of the second truss member. The first fastening mechanism is capable of extending through the first collection plate, the first force distribution bar and the tension plate to retain the tension plate in engagement with the first truss member. The second fastening mechanism is capable of extending through the second collection plate, the second force distribution bar and the tension plate to retain the tension plate in engagement with the second truss member.

Another embodiment of the invention is directed to a bolted truss splice that includes a force distribution bar, a collection plate, a tension plate, a truss member and a fastening mechanism. The force distribution bar has a first side surface, a second side surface and an end surface. The collection plate extends over at least part of the first side surface, second side surface and the end surface of the force distribution bar. The truss member has an end and a first side surface. The collection plate is attached to the first side surface of the truss member so that the force distribution bar is proximate the end of the truss member. The fastening mechanism is capable of extending through the collection plate, the force distribution bar and the tension to retain the tension plate in engagement with the truss member.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

An embodiment of the invention is directed to bolted truss plates for use in conjunction with truss members as illustrated in the accompanying drawings. The invention enables trusses having lengths such as 160 feet or longer to be fabricated in sections to facilitate transporting the trusses to the location where the truss is to be installed in a building.

Figure 1:
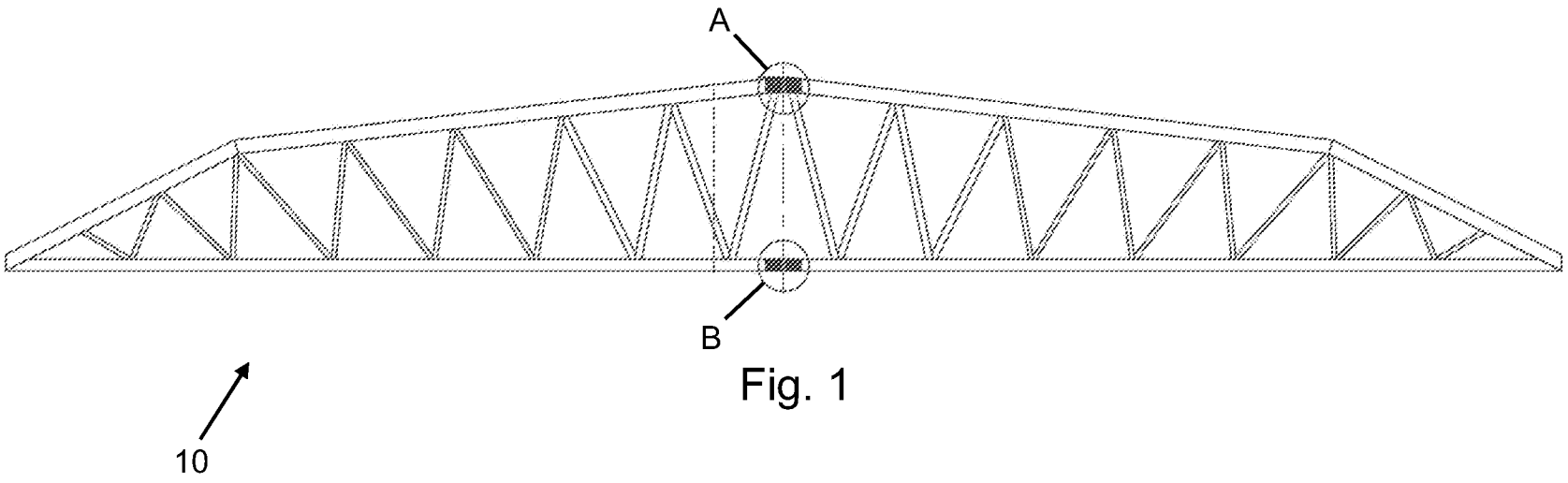
FIG. 1 is a side view of a truss in which bolted truss splices are used.
Figure 3:
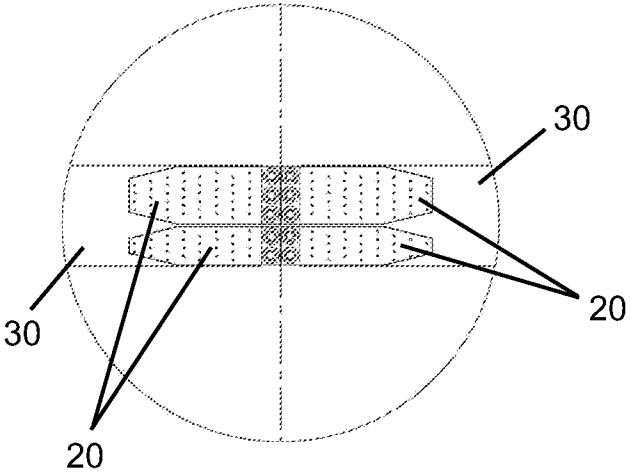
FIG. 3 is an enlarged side view of a second bolted truss splice taken from B in FIG. 1.
Figure 2:
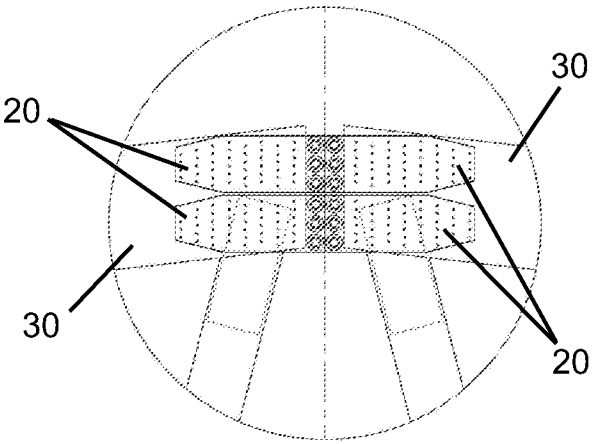
FIG. 2 is an enlarged side view of a first bolted truss splice taken from A in FIG. 1.

FIG. 1 is a side view of a truss 10 that includes two bolted truss splices. FIG. 2 is an enlarged view of the bolted truss splice that is along an upper truss member 30. Collection plates 20 used in this bolted truss splice each have a similar shape and size. FIG. 3 is an enlarged view of the bolted truss splice that is along a lower truss member 30. Collection plates 20 used in this bolted truss splice have a similar shape but the upper collection plates 20 are wider than the lower collection plates 20.

Figure 4:
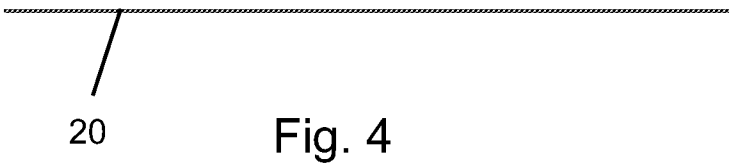
FIG. 4 is a top view of an initial configuration of a collection plate used in conjunction with an embodiment of a bolted truss splice.

As an initial aspect of the invention, a collection plate 20 is initially in a generally linear configuration as illustrated in FIG. 4. The collection plate 20 may assume a variety of configurations depending on the shape and size of the truss in which it is anticipated the collection plate 20 will be used.

In certain embodiments, the collection plate 20 is fabricated from a metallic material such as steel. In other embodiments, the collection plate 20 is fabricated from 16 gauge 50 ksi steel with G90 galvanization. A person of skill in the art will appreciate that other materials may be used to fabricate the collection plate 20 using the concepts of the invention.

A width of the collection plate 20 may be selected based upon a variety of factors such as the force that is anticipated to be placed on the truss and the width of the truss member to which the collection plate 20 is being attached. In certain embodiments, the collection plate 20 has a width of about 5.25 inches when 3 bolts are used across the width of the collection plate 20 and about 3.50 inches when 2 bolts are used across the width of the collection plate 20.

Figure 5:
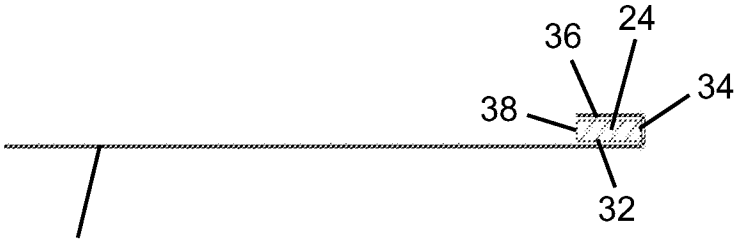
FIG. 5 is a top view of the collection plate after being formed to extended partially around a force distribution bar.

The collection plate 20 is extended at least partially around a force distribution bar 24 being an end of the collection plate 20 as illustrated in FIG. 5. In certain embodiments, the collection plate 20 extends over at least a first side surface 32, a first end surface 34 and a second side surface 36 of the force distribution bar 24.

Using this configuration causes an entire width of the collection plate 20 to be firmly squeezed between the force distribution bar 24 and the tension plate 40 when the bolted truss splice is fully assembled as is described in more detail herein. While not illustrated, it is also possible for the collection plate 20 to at least partially extend over a second end surface 38 of the force distribution bar 24, which is opposite the first end surface 34.

As a result of this configuration, the function of the bolts 50 is to squeeze the components of the bolted truss splice together providing a normal force that enables friction to be generated that transfer the load between the components of the bolted truss splice. This slip critical connection allows the relatively thin collection plate 20 and the nails or teeth that secure the collection plate to the truss member 30 to collect the load from the truss member and provides the mechanism to get that large force across the splice to the other side of the truss without local overstresses, which could lead to the failure of the collection plate 20 or other components of the bolted truss splice.

The force distribution bar 24 may be formed with an elongated profile such as illustrated in FIG. 5. In certain embodiments, a thickness of the force distribution bar 24 may be about ¼ to ⅓ of truss member 30.

The force distribution bar 24 is formed with a thickness based upon the thickness of the truss member 30, which is determined by the anticipated load that the bolted plate truss will be subjected to. In certain embodiments, the force distribution bar 24 has a thickness that is about ¼ of the thickness of the truss member 30. In other embodiments, the has a thickness of about ⅜ of an inch.

Figure 8:
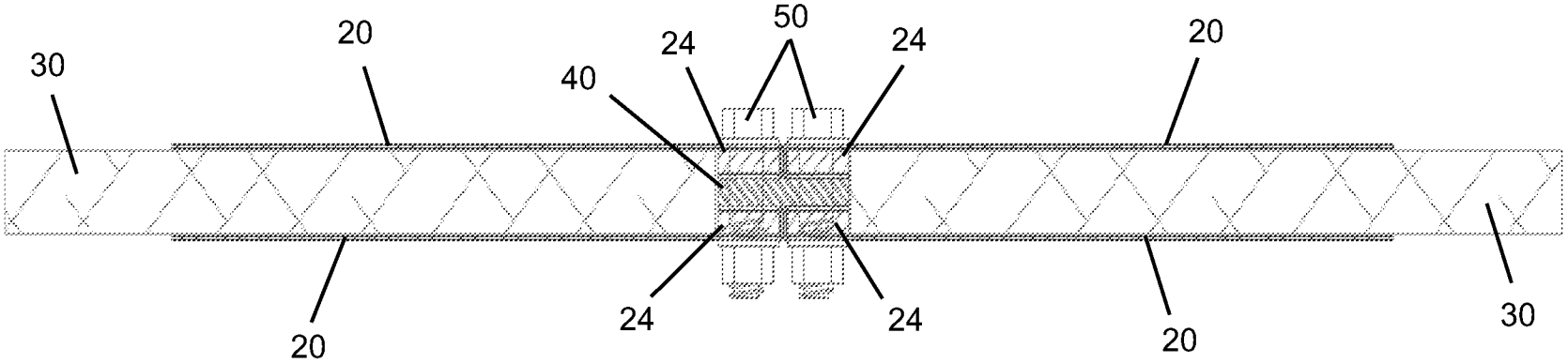
FIG. 8 is a top view of bolts attaching the two truss members together to form the bolted truss splice.

The force distribution bar 24 is formed with a width that is sufficiently large so that there is space on opposite sides of the bolt 50 that extends through the force distribution bar 24, as illustrated in FIG. 8. In certain embodiments, the width of the force distribution bar 24 is at least about 1.6 to 2 times a width of a portion of the bolt 50 that extends through the force distribution bar 24. In other embodiments, where the truss member 30 has a height of about 5.25 inches, the force distribution bar 24 has a height of about 5.25 inches and a width of about 1.75 inches. The apertures in the force distribution bars 24 may be formed with an obround shape having a width of about 0.750 inches and a length of about 0.813 inches.

The force distribution bar 24 may be fabricated from a variety of materials using the concepts of the invention. Suitable materials would have a low creep and a high strength. Examples of suitable materials include metallics and ceramics.

Figure 6:
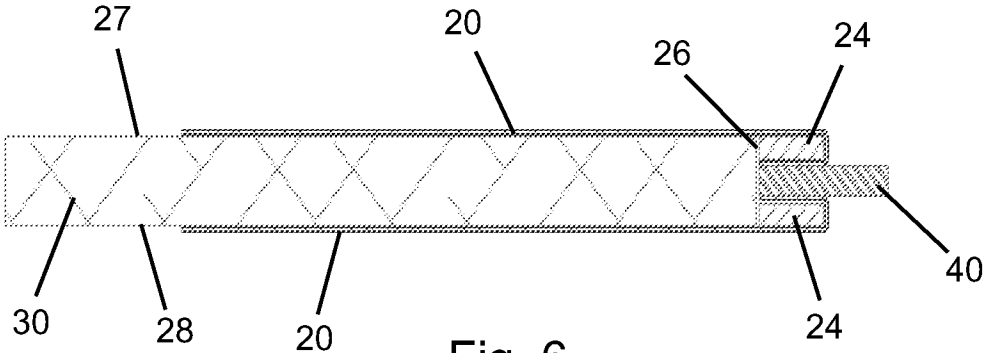
FIG. 6 is a top view showing two collection plates, two force distribution bars, a tension plate used in conjunction with a truss member.

FIG. 6 illustrates two collection plates 20 positioned along opposite side surfaces 27, 28 of the truss member 30. The collection plates 20 are positioned so that the force distribution bars 24 are adjacent to an end 26 of the truss member 30.

A variety of techniques may be used to secure the collection plates 20 to the truss members 30. Examples of suitable techniques for attaching the collection plates 20 to the truss members 30 are teeth, nails or bolts.

Figure 9:
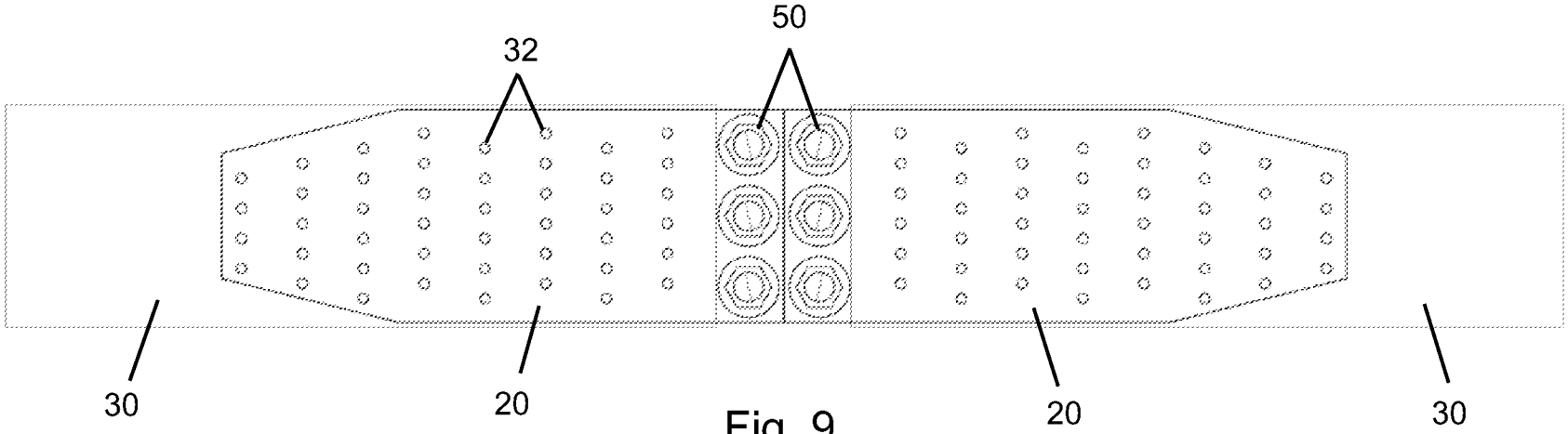
FIG. 9 is a side view of the bolted truss splice of FIG. 8.

FIG. 9 illustrates one suitable pattern for providing apertures 32 in the collection plate 20 through which the nails are inserted. The apertures 32 may be arranged in offset rows so that the nails used to attach the collection plates 20 on opposite sides 27, 28 of the truss member 30 are offset from each other.

In situations where nails are used, the apertures 32 may be formed with a diameter of about 0.125 inches. A variety of nails can be used. An example of a preferred nail has a diameter of about 0.148 inches and a length of about 1.4 inches. To ensure proper insertion of the nails, the nails may be inserted using a pneumatic nailing gun having a positive placement tip.

A person of skill in the art will appreciate that similar techniques may be used if teeth or bolts are used to attach the collection plates 20 to the truss member 30. The teeth may be integrally fabricated to the collection plate 20. The teeth may be distributed over a surface of the collection plate 20 to facilitate firmly attaching the collection plate 20 to the truss member 30.

A piercing cut required to start each hole may be located on the diameter parallel to the long side of the collection plate 20. This configuration minimizes the impact of any discontinuities associated with starting and ending the cut.

A benefit of this invention is that the collection plates 20 only nominally increase the thickness of the truss member 30 such that it is not necessary to account for an increased thickness of the truss member 30 associated with the connection of the truss sections.

Another benefit of the invention is that the collection plates 20 can be attached to the respective truss members 30 when the truss is being manufactured. As such, the invention does not cause a significant increase in the time needed to manufacture the truss or in the time needed to install the truss.

The invention also enables the truss to be fabricated in sections based upon size limitations for transporting the truss sections such that multiple truss sections can be attached together at the installation location.

A tension plate 40 is positioned between the force distribution bars 24 at the end 26 of the truss member 30 as illustrated in FIG. 6. Similar to the force distribution bars 24, the tension plate 40 may have apertures formed therein through which the bolts 50 are extended as illustrated in FIG. 8.

The tension plate 40 may be fabricated with a thickness that is approximately equal to a distance between the force distribution bars 24. The tension plate 40 may be fabricated with a length that is about 2 times the length of the force distribution bars 24. In other embodiments, where the truss member 30 has a height of about 5.25 inches, the tension plate 40 has a height of about 5.25 inches and a width of about 3.625 inches.

The tension plate 40 is formed with a thickness based upon the thickness of the truss member 30, which is determined by the anticipated load that the bolted plate truss will be subjected to. In certain embodiments, the tension plate 40 has a thickness that is about ⅓ of the thickness of the truss member 30. In other embodiments, the tension plate 40 has a thickness of about ⅝ of an inch.

Figure 7:
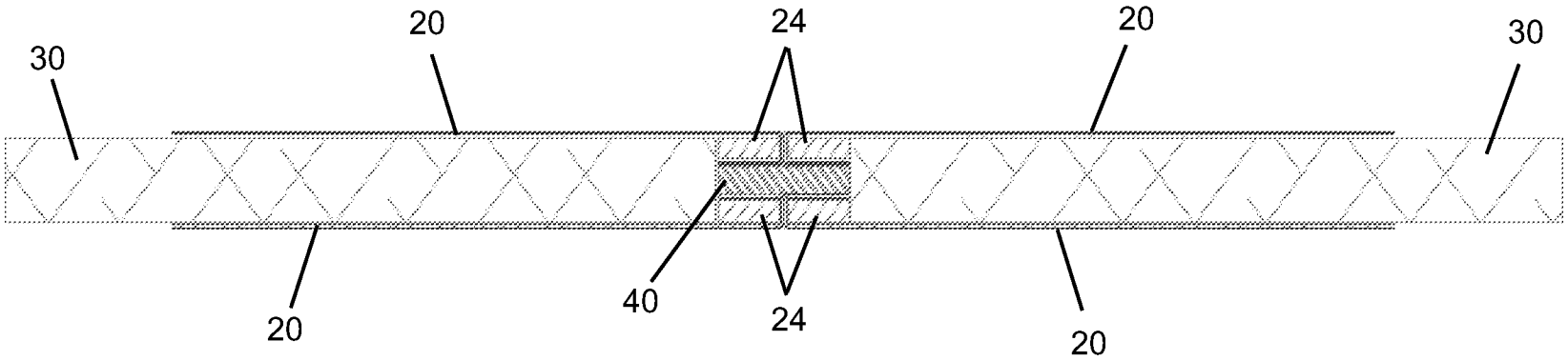
FIG. 7 is a top view of two truss members positioned adjacent to each other.

Using the preceding configuration enables the tension plate 40 to substantially fill the opening between the force distribution bars 24 when two of the truss members 30 are plated in an end-to-end relationship as illustrated in FIG. 7.

The tension plate 40 is fabricated from a strong material that resists bending or breakage based upon the forces that are anticipated to be placed on the truss. In certain embodiments, the tension plate 40 is fabricated from a metallic material.

In certain embodiments, corners of the collection plate 20 are chamfered as illustrated in FIG. 9. Using such a configuration enables the splice assembly to be located higher on the peak.

Prior to attachment of the truss members with the tension plate 40, the ends of the truss members 30 are placed adjacent to each other so that apertures in the collection plate 20 are aligned with apertures in the force distribution bar 24, and the tension plate 40 as illustrated in FIG. 7.

The bolts 50 are extended through the apertures in distribution plate 20, the force distribution bars 24 and the tension plate 40 as illustrated in FIG. 8. The bolts 50 facilitate providing the truss with bolted connections that are slip critical through the design range of the truss.

A person of skill in the art will appreciate that the bolts 50 may having a variety of configurations using the concepts of the invention. In certain embodiments, the bolts 50 are grade 8 with a fine thread and have a diameter of about ⅝ of an inch and a length of about 2.5 inches.

In certain embodiments, the bolts 50 are torqued to about 220 foot-pounds such as using a calibrated torque wrench. Because the bolts provide slip critical connections, it is preferred that lubricant not be used on the bolts 50.

While it is illustrated that a symmetrical bolted connection is used for attaching the truss members 30 on each side of the tension plate 40, it is possible to design for a single connection by factory installing the tension plate 40 and bolts 50 on one side of the splice. In other embodiments, welds are used instead of bolts. The capacity of the truss system is limited by the plate capacity at the first row of bolts.

Figure 10:
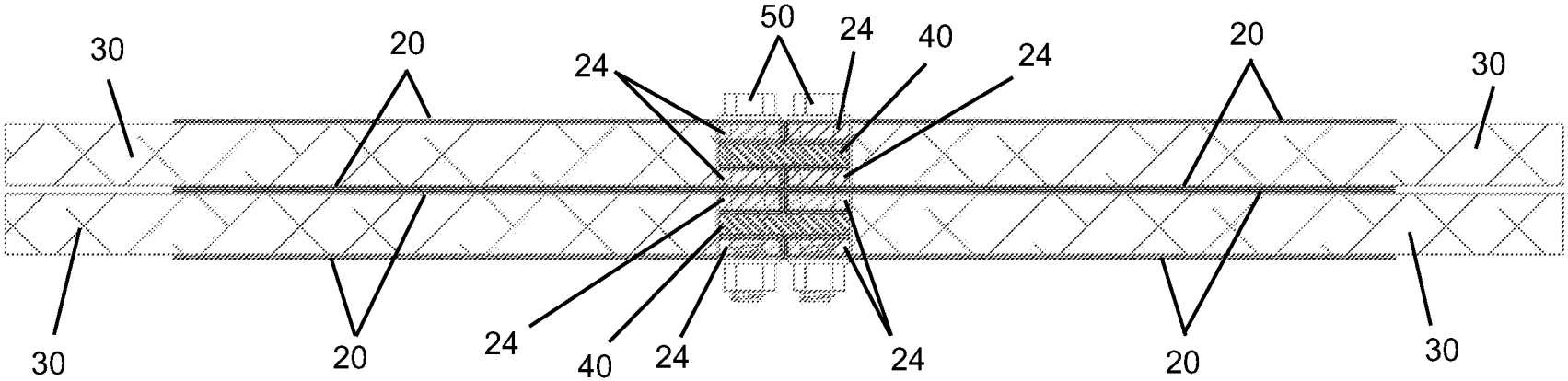
FIG. 10 is a top view of an alternative embodiment of the invention that includes two truss members on each side to form the bolted truss splice.

In another embodiment, which is illustrated in FIG. 10, multiple truss members 30 may be positioned adjacent to each other to increase the strength of the truss based upon the project specifications for the intended application. Other than the increased thickness of the multiple truss member 30, the other aspects of this embodiment may be similar to the configuration of the invention described with respect to FIGS. 1-9.

The truss is fabricated in at least 2 sections. Each of the truss sections has a length and a height that complies with vehicle size restrictions for the roads over which the truss is transported between a manufacturing location and an installation location. This means that it is not necessary to obtain permits for transporting the truss from the manufacturing location and the installation location. The invention also enables trusses to be manufactured in sizes that are larger than can be transported on conventional trailers.

Once the truss is delivered to a location where it is intended to be installed, the trusses are positioned with the truss members 30 in an end-to-end configuration with one of the tension plates between them as illustrated in FIG. 7. Bolts 50 are extended through the apertures as illustrated in FIG. 8 to secure the truss members 30 together. The tightening of the bolts 50 squeezes the splice assembly together. The collection plates 20 are squeezed between the force distribution bar 24 and the tension plate 40 such that the collection plate 20 cannot pull free from the assembly. Similarly, the tension plate 40 is gripped between collection plates and cannot pull free. In such a configuration, the entire width of the tension plate 40 and the collection plate 20 are engaged in resisting tensile forces after the truss is installed.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A bolted truss splice comprising:

a force distribution bar that comprises a first side surface, a second side surface and an end surface;

a collection plate that extends over at least part of the first side surface, second side surface and the end surface of the force distribution bar;

a tension plate positioned beneath the force distribution bar;

a truss member having an end and a first side surface, wherein the collection plate is attached to the first side surface of the truss member so that the force distribution bar is proximate the end of the truss member; and a fastening mechanism extending through the collection plate, the force distribution bar and the tension plate to retain the tension plate in engagement with the truss member.

2. The bolted truss splice of claim 1, wherein the collection plate extends substantially over the first side surface of the force distribution bar, the second side surface of the force distribution bar and the end surface of the force distribution bar.

3. The bolted truss splice of claim 1, wherein the end surface of the force distribution bar is between the first side surface of the force distribution bar and the second side surface of the force distribution bar.

4. The bolted truss splice of claim 1, wherein the force distribution bar, the collection plate and the tension plate each have an aperture formed therein through which the fastening mechanism extends.

5. The bolted truss splice of claim 1, wherein the collection plate is attached to the truss member using at least one of teeth that extend from the collection plate or nails that extend through the collection plate and into the truss member.

6. The bolted truss splice of claim 1, wherein the end of the truss member is adjacent to the first side surface of the truss member and wherein the truss member has a first thickness, wherein the force distribution bar, the collection plate and the tension have a combined second thickness and wherein the first thickness is approximately equal to the second thickness.

7. A bolted truss splice comprising:

a first truss comprising:

a first force distribution bar that comprises a first side surface, a second side surface and an end surface;

a first collection plate that extends over at least part of the first side surface of the first force distribution bar, the second side surface of the first force distribution bar and the end surface of the first force distribution bar;

a first truss member having an end, a first side surface and a second side surface that is opposite the first side surface of the first truss member, wherein the first collection plate is attached to first side surface of the first truss member so that the first force distribution bar is proximate the end of the first truss member; and a second truss comprising:

a second force distribution bar that comprises a first side surface, a second side surface and an end surface;

a second collection plate that extends over at least part of the first side surface of the second force distribution bar, the second side surface of the second force distribution bar and the end surface of the second force distribution bar;

a second truss member having an end, a first side surface and a second side surface that is opposite the first side surface of the second truss member, wherein the second collection plate is attached to the first side surface of the second truss member so that the second force distribution bar is proximate the end of the second truss member;

a tension plate positioned beneath the first force distribution bar and the second force distribution bar;

a first fastening mechanism configured to extend through the first collection plate, the first force distribution bar and the tension plate to retain the tension plate in engagement with the first truss member; and a second fastening mechanism configured to extend through the second collection plate, the second force distribution bar and the tension plate to retain the tension plate in engagement with the second truss member.

8. The bolted truss splice of claim 7, wherein the first collection plate extends substantially over the first side surface of the first force distribution bar, the second side surface of the first force distribution bar and the end surface of the first force distribution bar.

9. The bolted truss splice of claim 7, wherein the end surface of the first force distribution bar is between the first side surface of the first force distribution bar and the second side surface of the first force distribution bar.

10. The bolted truss splice of claim 7, wherein the first force distribution bar, the first collection plate, the second force distribution bar, the second collection plate and the tension plate each have an aperture formed therein through which the fastening mechanism extends.

11. The bolted truss splice of claim 7, wherein the first collection plate is attached to the first truss member using at least one of teeth that extend from the first collection plate or nails that extend through the first collection plate and into the first truss member.

12. The bolted truss splice of claim 7, wherein the first truss further comprises:

a third force distribution bar that comprises a first side surface, a second side surface and an end surface; and a third collection plate that extends over at least part of the first side surface of the third force distribution bar, the second side surface of the third force distribution bar and the end surface of the third force distribution bar, wherein the third collection plate is attached to second side surface of the first truss member so that the third force distribution bar is proximate the end of the first truss member and wherein the first fastening mechanism further extends through the third force distribution plate and the third collection plate; and wherein the second truss further comprises:

a fourth force distribution bar that comprises a first side surface, a second side surface and an end surface; and a fourth collection plate that extends over at least part of the first side surface of the fourth force distribution bar, the second side surface of the fourth force distribution bar and the end surface of the fourth force distribution bar, wherein the fourth collection plate is attached to the second side surface of the second truss member so that the fourth force distribution bar is proximate the end of the second truss member and wherein the second fastening mechanism further extends through the fourth force distribution bar and the fourth collection plate.

13. The bolted truss splice of claim 12, wherein the first truss member has a first thickness, wherein the first force distribution bar, the first collection plate, the third force distribution bar, the third collection plate and the tension plate have a combined second thickness and wherein the first thickness is approximately equal to the second thickness.

14. A bolted truss splice comprising:

a first force distribution bar that comprises a first side surface, a second side surface and an end surface;

a first collection plate that extends over at least part of the first side surface of the first force distribution bar, the second side surface of the first force distribution bar and the end surface of the first force distribution bar;

a second force distribution bar that comprises a first side surface, a second side surface and an end surface;

a second collection plate that extends over at least part of the first side surface of the second force distribution bar, the second side surface of the second force distribution bar and the end surface of the second force distribution bar;

a tension plate positioned between the first force distribution bar and the second force distribution bar;

a truss member having an end, a first side surface and a second side surface that is opposite the first side surface of the truss member, wherein the first collection plate is attached to first side surface of the truss member so that the first force distribution bar is proximate the end of the truss member and wherein the second collection plate is attached to the second side surface of the truss member so that the second force distribution bar is proximate the end of the truss member; and a fastening mechanism configured to extend through the first collection plate, the first force distribution bar, the second collection plate, the second force distribution bar and the tension plate to retain the tension plate in engagement with the truss member.

15. The bolted truss splice of claim 14, wherein the first collection plate extends substantially over the first side surface of the first force distribution bar, the second side surface of the first force distribution bar and the end surface of the first force distribution bar.

16. The bolted truss splice of claim 14, wherein the end surface of the first force distribution bar is between the first side surface of the first force distribution bar and the second side surface of the first force distribution bar.

17. The bolted truss splice of claim 14, wherein the first force distribution bar, the first collection plate, the second force distribution bar, the second collection plate and the tension plate each have an aperture formed therein through which the fastening mechanism extends.

18. The bolted truss splice of claim 14, wherein the end of the truss member extends between the first side surface of the truss member and the second side surface of the truss member.

19. The bolted truss splice of claim 14, wherein the truss member has a first thickness, wherein the first force distribution bar, the first collection plate, the second force distribution bar, the second collection plate and the tension plate have a combined second thickness and wherein the first thickness is approximately equal to the second thickness.

20. The bolted truss splice of claim 11, wherein the first collection plate is attached to the truss member using at least one of teeth that extend from the first collection plate or nails that extend through the first collection plate and into the truss member.

* * * * *